US007280775B2

(12) United States Patent
Kubochi et al.

(10) Patent No.: US 7,280,775 B2
(45) Date of Patent: Oct. 9, 2007

(54) IMAGE-FORMING APPARATUS AND RECORDING-MEDIUM-TEMPERATURE DETECTOR UNIT USED IN THE SAME

(75) Inventors: Yutaka Kubochi, Mishima (JP); Eiichiro Kimizuka, Mishima (JP); Fumiki Inui, Mishima (JP); Satoru Izawa, Suntoh-Gun (JP); Masataka Mochiduki, Suntoh-Gun (JP); Toshihiko Ochiai, Tokyo (JP); Takao Kawadu, Numazu (JP); Koji Nihonyanagi, Susono (JP); Shinji Hashiguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 289 days.

(21) Appl. No.: 11/055,786

(22) Filed: Feb. 11, 2005

(65) Prior Publication Data

US 2005/0201788 A1 Sep. 15, 2005

(30) Foreign Application Priority Data

Feb. 27, 2004 (JP) ..... 2004-054638
Apr. 9, 2004 (JP) ..... 2004-115595
Apr. 9, 2004 (JP) ..... 2004-115597

(51) Int. Cl.
*G03G 15/20* (2006.01)

(52) U.S. Cl. ..... 399/33; 399/67; 399/122; 399/320; 399/322; 374/141; 374/153

(58) Field of Classification Search ..... None
See application file for complete search history.

(56) References Cited

U.S. PATENT DOCUMENTS 5,434,658 A 7/1995 Kwon ..... 355/285
5,508,796 A 4/1996 Sasame et al. ..... 355/271
5,543,904 A 8/1996 Kato et al. ..... 355/285
5,761,571 A 6/1998 Suzuki et al. ..... 399/66
5,860,051 A 1/1999 Goto et al. ..... 399/529
5,920,757 A * 7/1999 Izawa et al. ..... 399/329
5,960,233 A 9/1999 Goto et al. ..... 399/69
6,016,418 A 1/2000 Kabeya et al. ..... 399/314
6,151,477 A 11/2000 Takeuchi et al. ..... 399/318
6,167,216 A * 12/2000 Hori ..... 399/69
6,298,213 B1 10/2001 Miyamoto et al. ..... 399/320
6,366,745 B1 4/2002 Adachi et al. ..... 399/68

(Continued)

FOREIGN PATENT DOCUMENTS

EP 0 676 677 10/1995

(Continued)

OTHER PUBLICATIONS

Official Action/Search Report dated Jun. 14, 2005, from the European Patent Office (Application No. 05002513.9).

*Primary Examiner*—Daniel J. Colilla
*Assistant Examiner*—Wynn Q. Ha
(74) *Attorney, Agent, or Firm*—Fitzpatrick, Cella, Harper & Scinto

(57) ABSTRACT

An image-forming apparatus includes a movable lever which functions as a recording medium detector for detecting the passage of a recording medium and a temperature detecting portion provided on the movable lever. The temperature of the recording medium is detected without providing an additional space for a sensor for detecting the temperature of the recording medium.

49 Claims, 13 Drawing Sheets

U.S. PATENT DOCUMENTS

| | | | | |
|---|---|---|---|---|
| 6,404,998 | B1 | 6/2002 | Tanaka et al. | 399/66 |
| 6,493,521 | B2 | 12/2002 | Miyamoto et al. | 399/44 |
| 6,519,426 | B2 | 2/2003 | Goto et al. | 399/69 |
| 6,647,216 | B2 * | 11/2003 | Tanaka | 399/21 |
| 6,671,488 | B2 | 12/2003 | Izawa et al. | 399/329 |
| 6,701,102 | B2 | 3/2004 | Hasegawa et al. | 399/69 |
| 6,713,725 | B2 | 3/2004 | Izawa et al. | 219/216 |
| 6,748,192 | B2 | 6/2004 | Izawa et al. | 399/329 |
| 6,763,205 | B2 | 7/2004 | Izawa et al. | 399/69 |
| 6,862,416 | B2 | 3/2005 | Hashiguchi et al. | 399/69 |
| 6,915,099 | B2 | 7/2005 | Izawa et al. | 399/328 |
| 6,920,293 | B2 | 7/2005 | Izawa et al. | 399/67 |
| 2003/0206756 | A1 | 11/2003 | Kanamori et al. | 399/328 |
| 2004/0037579 | A1 | 2/2004 | Hashiguchi et al. | 399/67 |

FOREIGN PATENT DOCUMENTS

| | | | |
|---|---|---|---|
| EP | 676677 | A2 * | 10/1995 |
| JP | 1-150185 | | 6/1989 |
| JP | 1-160473 | | 6/1989 |
| JP | 3-53276 | | 3/1991 |
| JP | 4-181250 | | 6/1992 |
| JP | 6-308854 | | 11/1994 |
| JP | 7-230231 | | 8/1995 |
| JP | 7-239647 | | 9/1995 |
| JP | 10-161468 | | 6/1998 |
| JP | 2000-66461 | | 3/2000 |
| JP | 2001-13816 | | 1/2001 |
| JP | 2001282036 | A * | 10/2001 |
| JP | 2002-23555 | | 1/2002 |
| JP | 2002156866 | A * | 5/2002 |
| JP | 2002-214961 | | 7/2002 |
| JP | 2002214961 | A * | 7/2002 |
| JP | 2003-29485 | | 1/2003 |
| JP | 2003140502 | A * | 5/2003 |
| JP | 2003280447 | A * | 10/2003 |
| JP | 2003330315 | A * | 11/2003 |

* cited by examiner

IMAGE-FORMING APPARATUS AND RECORDING-MEDIUM-TEMPERATURE DETECTOR UNIT USED IN THE SAME

BACKGROUND OF THE INVENTION

1. Field of the Invention

The present invention relates to image-forming apparatuses, such as copy machines and printers, using recording techniques such as electrophotographic recording and electrostatic recording and recording-medium-temperature detector unit used in the image-forming apparatuses. More specifically, the present invention relates to an image-forming apparatus having a temperature detecting portion for detecting a temperature of a recording medium after a heat-fixing process and a recording-medium-temperature detector unit used in the image-forming apparatus.

2. Description of the Related Art

A typical image-forming apparatus, such as a copy machine and a printer, using recording techniques such as electrophotographic recording and electrostatic recording includes a fixing device for fixing a toner image formed on a recording medium by applying heat, and various techniques for improving the fixability of the image are suggested.

For example, a method in which the temperature of a recording medium is detected after a heat-fixing process and feedback control is performed for obtaining a desired temperature in a fixing device has been suggested (refer to, for example, Japanese Patent Laid-Open No. 1-150185, Japanese Utility Model Laid-Open No. 1-160473, Japanese Patent Laid-Open No. 3-53276, Japanese Patent Laid-Open No. 4-181250, Japanese Patent Laid-Open No. 6-308854, Japanese Patent Laid-Open No. 7-230231, Japanese Patent Laid-Open No. 7-239647, Japanese Patent Laid-Open No. 10-161468, Japanese Patent Laid-Open No. 2000-66461, Japanese Patent Laid-Open No. 2001-13816, Japanese Patent Laid-Open No. 2002-23555, Japanese Patent Laid-Open No. 2002-214961, and Japanese Patent Laid-Open No. 2003-29485).

FIG. 10 shows an example of a heat-fixing device in which the recording medium temperature is detected by a non-contact sensor after a heat-fixing process. In this heat-fixing device, a non-contact sensor 20, such as an infrared radiation sensor, is positioned downstream of a fixing nip portion for measuring the recording medium temperature without contact.

FIG. 11 shows an example of a heat-fixing device in which the recording medium temperature is detected by a contact sensor after a heat-fixing process. In this heat-fixing device, a temperature sensor 18, such as a thermistor, is positioned downstream of a fixing nip portion and an opposing member 19, such as a rubber roller, is positioned so as to face the temperature sensor 18. The temperature of the recording medium is measured while the recording medium is nipped between the temperature sensor 18 and the opposing member 19.

However, in the case in which the recording medium temperature is detected and used in the feedback control, there is a problem that the temperature cannot be detected with sufficient accuracy.

In the heat-fixing process of the recording medium, moisture in the recording medium is also heated, and water vapor is emitted from the surface of the recording medium. When a non-contact sensor is used for temperature detection, it is difficult to accurately detect the recording medium temperature since the water vapor adheres on the surface of the non-contact sensor.

In addition, in the case in which the temperature sensor is brought into contact with the opposing member like the roller and the recording medium temperature is detected while the recording medium is nipped between the temperature sensor and the opposing member, the heat of the recording medium is dissipated into the opposing member. Therefore, it is also difficult to accurately detect the recording medium temperature in this case.

On the other hand, the size of image-forming apparatuses has recently been reduced, and it is difficult to provide a space for an additional temperature sensor.

SUMMARY OF THE INVENTION

In view of the above-described problems, the present invention provides an image-forming apparatus in which the size thereof is prevented from being increased in order to provide a space for a sensor for detecting the recording medium temperature and a recording-medium-temperature detector unit used in the image-forming apparatus.

In addition, the present invention also provides an image-forming apparatus capable of setting adequate fixing conditions irrespective of the kind of a recording medium.

Further, the present invention provides an image-forming apparatus in which the recording medium temperature is detected with high accuracy.

According to the present invention, an image-forming apparatus includes an image-forming unit which forms an image on a recording medium; a temperature detector which detects a temperature of the recording medium; and a recording medium detector which detects a passage of the recording medium, the recording medium detector including a moving member which moves when the recording medium comes into contact with the moving member. A temperature detecting portion of the temperature detector is disposed on the moving member.

In addition, according to the present invention, a recording-medium-temperature detector unit for use in an image-forming apparatus which forms an image on a recording medium includes a movable lever which is composed of resin and which moves when the recording medium comes into contact with the movable lever; a temperature-detecting element provided on the movable lever; and an elastic conductive member provided on the movable lever and electrically connected to the temperature-detecting element. The conductive member defines a signal path for the temperature-detecting element and applies an elastic force for urging the movable lever against the recording medium.

In addition, according to the present invention, an image-forming apparatus includes an image-forming unit which forms an image on a recording medium; a movable lever which is composed of resin and which moves when the recording medium comes into contact with the movable lever; a heat transmit plate provided on the movable lever such that the heat transmit plate comes into contact with the recording medium at one side of the heat transmit plate; a temperature-detecting element provided on the other side of the heat transmit plate; and a conductive part which is electrically connected to a grounding path, the conductive part being positioned so as to prevent an electric discharge to the temperature-detecting element.

In addition, according to the present invention, an image-forming apparatus includes an image-forming unit which forms an image on a recording medium; a movable lever which is composed of resin and which moves when the recording medium comes into contact with the movable lever; a heat transmit plate provided on the movable lever such that the heat transmit plate comes into contact with the recording medium at one side of the heat transmit plate; a temperature-detecting element provided on the other side of the heat transmit plate; and a conductive part electrically connected to both the heat transmit plate and a grounding path.

In addition, according to the present invention, a recording-medium-temperature detector unit for use in an image-forming apparatus which forms an image on a recording medium includes a movable lever which is composed of resin and which moves when the recording medium comes into contact with the movable lever; a heat transmit plate provided on the movable lever such that the heat transmit plate comes into contact with the recording medium at one side of the heat transmit plate; a temperature-detecting element provided on the other side of the heat transmit plate; and a conductive part which is electrically connected to a grounding path, the conductive part being positioned so as to prevent an electric discharge to the temperature-detecting element.

In addition, according to the present invention, a recording-medium-temperature detector unit for use in an image-forming apparatus which forms an image on a recording medium includes a movable lever which is composed of resin and which moves when the recording medium comes into contact with the movable lever; a heat transmit plate provided on the movable lever such that the heat transmit plate comes into contact with the recording medium at one side of the heat transmit plate; a temperature-detecting element provided on the other side of the heat transmit plate; and a conductive part electrically connected to both the heat transmit plate and a grounding path.

Further features and advantages of the present invention will become apparent from the following description of exemplary embodiments with reference to the attached drawings.

DESCRIPTION OF THE EMBODIMENTS

First Embodiment

Figure 9:
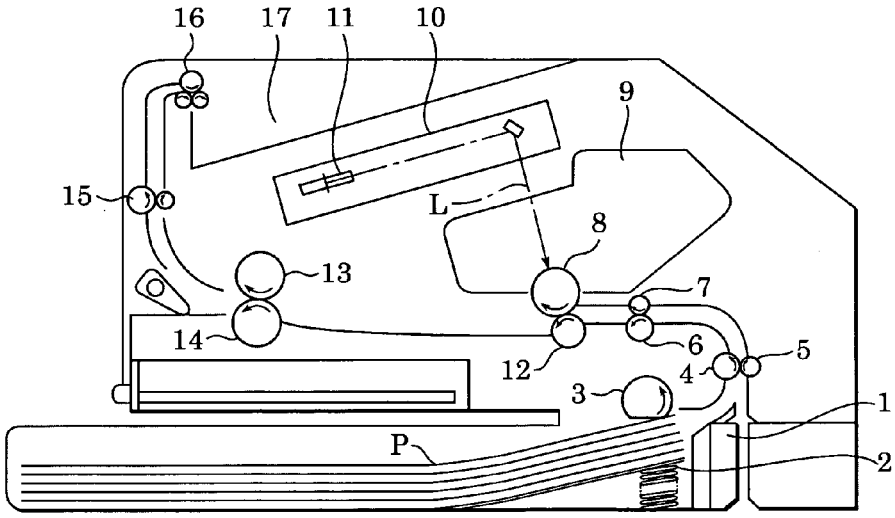
FIG. 9 is a sectional view showing an electrophotographic printer as an example of an image-forming apparatus according to the present invention.
Figure 10:
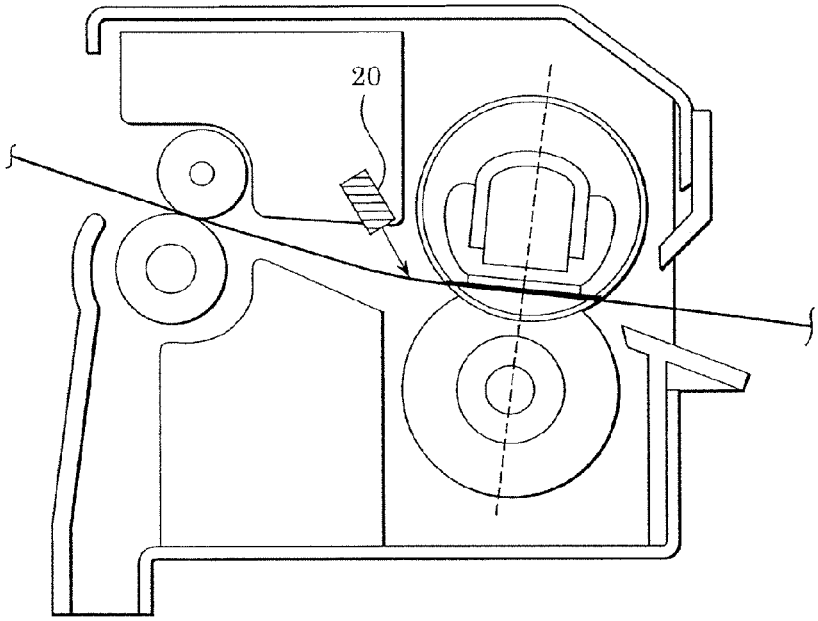
PRIOR ART FIG. 10
FIG. 10 is a sectional view showing the manner in which a recording medium temperature is detected using a non-contact temperature sensor.
Figure 11:
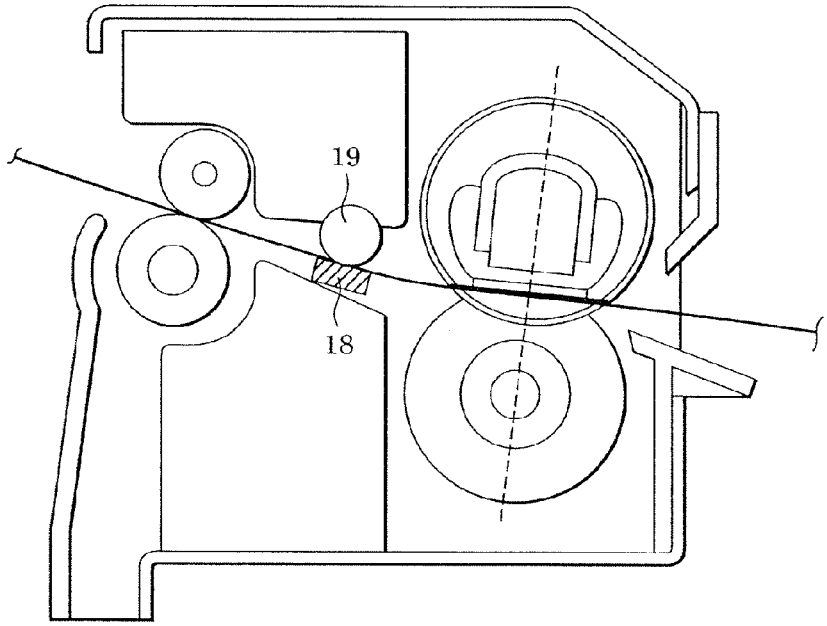
PRIOR ART FIG. 11
FIG. 11 is a sectional view showing the manner in which a recording medium temperature is detected while a recording medium is nipped between a temperature sensor and an opposing roller.

FIG. 9 is a schematic sectional view showing an electrophotographic printer as an example of an image-forming apparatus to which the present invention is applied.

This printer is provided with a sheet-feeding device including a paper feed tray 1, a sheet-supporting plate 2, and a paper feed roller 3. A stack of recording media P is placed on the sheet-supporting plate 2 in the paper feed tray 1, and the recording medium at the top is picked up by the paper feed roller 3 and is conveyed to a register section by conveying rollers 4 and 5. The conveying direction of the recording medium is adjusted in the register section including register rollers 6 and 7, and the recording medium is then fed to an image-forming unit.

In the image-forming unit, a photosensitive drum 8, a charging device (not shown) placed at the periphery of the photosensitive drum 8 for charging the photosensitive drum 8, a developing device (not shown) for developing a latent image formed on the photosensitive drum 8 with toner, and a cleaner (not shown) for removing the residual toner on the photosensitive drum 8 are integrated as a toner cartridge 9, which is detachably attached to the main body of the printer. A laser scanner unit 10 for forming an image corresponding to image information on the photosensitive drum 8 includes a laser source (not shown), a laser deflection mirror (polygon mirror) 11, a deflection mirror rotation motor (not shown), etc.

In the printer, when the image information is input, a laser beam L based on image information scans the photosensitive drum 8 which is charged to a predetermined potential by the charging device. Thus, an electrostatic latent image is formed on the photosensitive drum 8. Then, the developing device develops the latent image with the toner, which functions as a developer. Then, the developed toner image is transferred onto the recording medium from the photosensitive drum 8 by the transfer roller 12.

The recording medium on which the toner image is transferred is conveyed to a fixing unit including a heating unit 13 and a back-up unit 14, and the toner image on the recording medium is fixed by applying heat. Then, the recording medium is output onto an output tray 17 from a paper output unit including a middle output roller 15, an output roller 16, etc.

Figure 1:
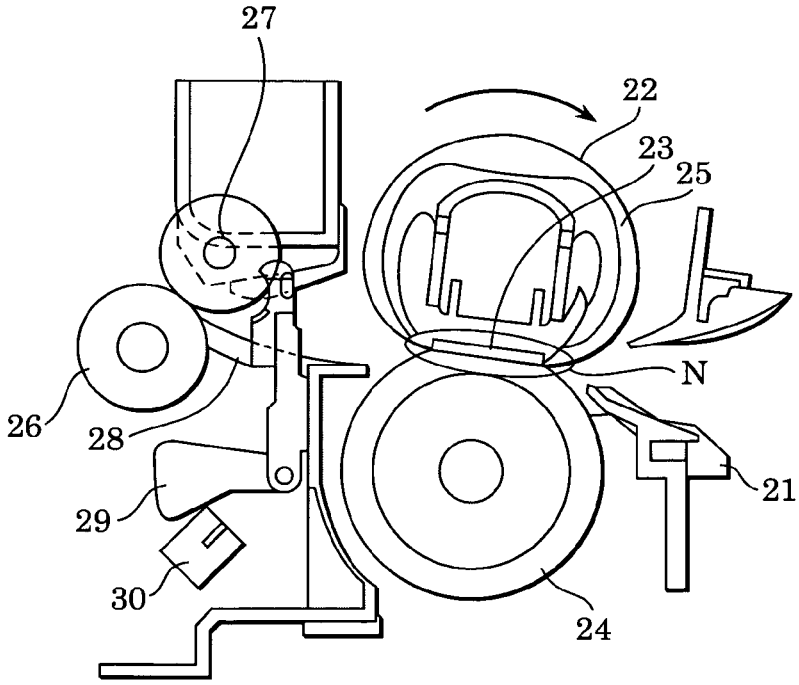
FIG. 1 is a sectional view showing a region around a sensor lever according to a first embodiment of the present invention in a state in which the recording medium is not being conveyed.
Figure 2:
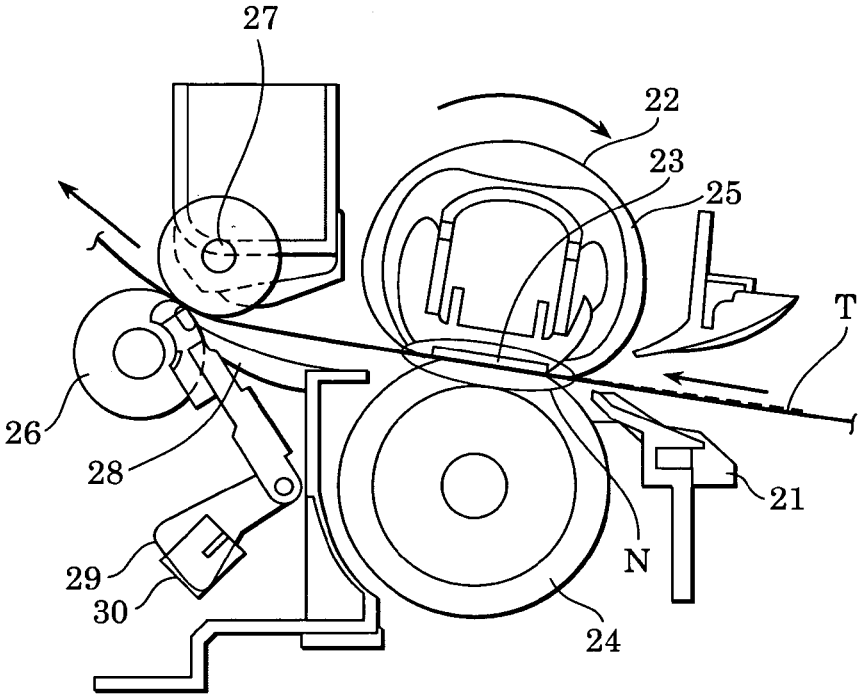
FIG. 2 is a sectional view showing the region around the sensor lever according to the first embodiment of the present invention in a state in which the recording medium is being conveyed.
Figure 3:
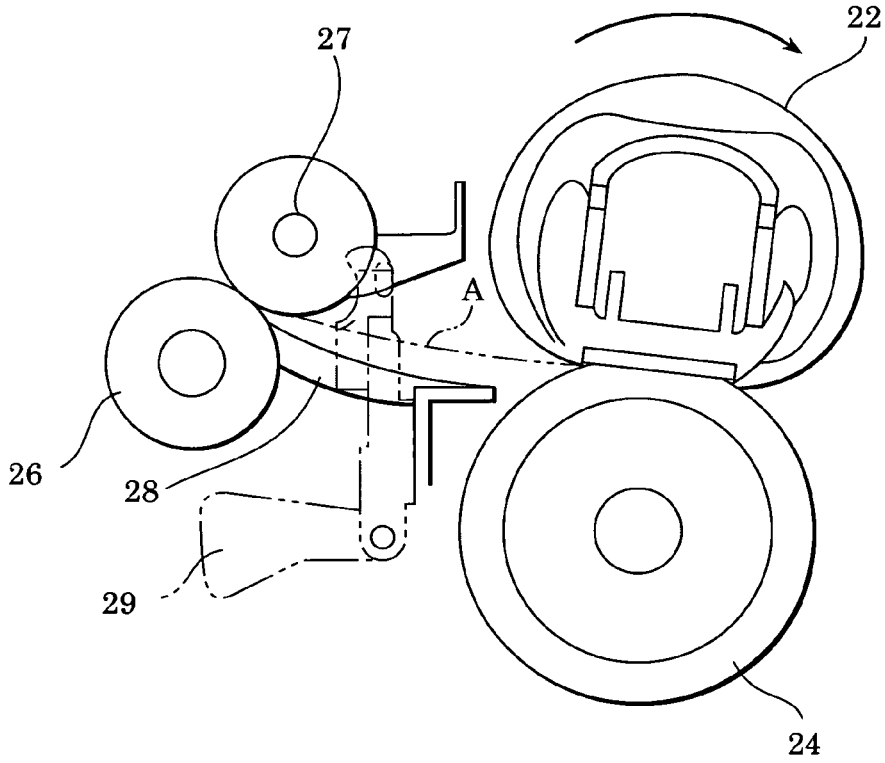
FIG. 3 is a sectional view showing the positional relationship between an imaginary line connecting a fixing nip portion and an output roller nip portion and a recording medium conveyor guide according to the first embodiment of the present invention.

FIGS. 1 to 3 are sectional views showing a region around a heat-fixing device and a recording-medium detector which detects the recording medium after the heat-fixing process.

The printer according to the present embodiment includes a heat-fixing device (on-demand fixing device) of a film-heating type which heats the recording medium via a film-shaped or belt-shaped flexible sleeve (hereafter called a fixing film). However, the present invention is not limited to image-forming apparatuses including such an on-demand fixing device, and may be applied to image-forming apparatuses including various types of heat-fixing devices, such as a heat-fixing device of a heat roller type. In this type of heat-fixing device, a recording medium is heated while it is conveyed between a heating roller and a pressure roller. The temperature of the heating roller is controlled and maintained at a predetermined temperature, and the pressure roller has an elastic layer which comes into press contact with the heating roller.

After the toner image formed in the image-forming unit is transferred onto the recording medium, the recording medium is conveyed to the heat-fixing unit. The heat-fixing unit mainly includes the heating unit 13 and the back-up unit 14, and a front end of the recording medium is guided to a pressure nip portion (fixing nip portion) N including the heating unit 13 and the back-up unit 14 via an entrance guide 21.

The heating unit mainly includes a fixing film 22, a heater (heating element) 23 which is in contact with the inner surface of the fixing film 22, a film guide 25 which retains the heater 23 and guides the fixing film 22, and a metal stay which presses the film guide 25 against the back-up unit. The back-up unit mainly includes a pressure roller 24. An end of the metal stay is urged against the pressure roller 24 by a force of a coil spring or the like, and accordingly a pressure is applied to the fixing nip portion N.

The fixing film 22 has a release layer on the surface. In addition, the fixing film 22 is fitted around the film guide 25 having a semi-arc cross section with an allowance provided along the periphery of the film guide 25.

The fixing film 22 preferably has a small thermal capacity to ensure quick start. For example, the total thickness of the fixing film 22 is 100 μm or less, preferably in the range of 20 μm to 60 μm. In addition, a base layer of the fixing film 22 is preferably composed of a heat-resistant resin film made of polyimide, PEEK, or the like. Alternatively, the base layer may also be composed of a metal film made of Ni by electroforming or stainless steel. Since metal films have good thermal conductivity, quick start can be ensured with the thickness of 150 μm or less.

The heating element 23 is, for example, a ceramic heater in which a heat generating element (resistor pattern) is formed on a ceramic substrate. The resistor pattern serves as a heat source which generates heat when electric power is applied. Heat is generated from the resistor pattern when the resistor pattern is electrified, and the heater temperature is increased accordingly. The heating element 23 is formed by thick-film screen printing in which a resistor paste of silver palladium is applied on a substrate made of alumina ($Al_2O_3$) or aluminum nitride (AlN) to form a resistor pattern having desired resistance. In addition, a glass layer is formed on the resistor pattern. The glass layer functions as a sliding layer which slides along the inner surface of the fixing film 22 while protecting the resistor pattern. A thermistor, which functions as a temperature-detecting element, is adhered on a surface of the substrate on the side opposite to the side where the resistor pattern is formed. The temperature information monitored by the thermistor is input to a control circuit (not shown). The control circuit controls an AC driver to adjust the amount of electricity applied to the heating element 23 (resistor pattern) from an AC power source so that the detected temperature is maintained at a set temperature.

The pressure roller 24 has an elastic layer made of silicone rubber provided around a core bar made of iron, aluminum, or the like and a PFA tube layer provided around the elastic layer as a release layer. The pressure roller 24 is driven by a driving motor (not shown).

The fixing film 22 receives a driving force from the pressure roller 24 and is rotated clockwise in FIG. 1 by the rotation of the pressure roller 24. The recording medium on which the unfixed toner image is formed is conveyed through the fixing nip portion N including the fixing film 22, the heating element 23, and the pressure roller 24. The toner image is fixed on the recording medium when the recording medium passes through the fixing nip portion N.

As described above, while the recording medium passes through the fixing nip portion N, the heating element 23 applies thermal energy to the recording medium via the fixing film 22. Thus, the unfixed toner image on the recording medium is fixed. After passing through the fixing nip portion N and being released from the fixing film 22, the recording medium P is conveyed to a paper output unit by a pair of paper output rollers (conveying unit) 26 and 27.

Next, a recording-medium-temperature detector unit, which characterizes the present invention, will be described below. Although the image-forming apparatus according to the present embodiment has only a single-sided printing function and cannot perform double-sided printing, the present invention may be applied to both an image-forming apparatus having the double-sided printing function and an image-forming apparatus having only the single-sided printing function.

According to the present invention, the temperature detector unit includes a temperature detecting portion provided on a moving member (sensor lever in the present embodiment) of a recording medium detector which detects the passage of the recording medium. In the present embodiment, the temperature detecting portion is arranged such that it comes into contact with a surface of the recording medium on the side opposite to the side on which an image is formed in single-sided printing (that is, on the unprinted side). In addition, the temperature detecting portion comes into contact with the recording medium at a position between the fixing nip portion and a conveying member nearest to the fixing nip portion on the downstream of the fixing nip portion in the recording-medium conveying direction.

The structure in which the temperature is detected at the unprinted side of the recording medium provides two advantages described below. Regarding the first advantage, in normal single-sided printing, the side of the recording medium opposite to the side on which the toner is being fixed comes into contact with a heat transmit plate (hereafter called a heat collector plate). Therefore, the toner does not easily adheres to the heat collector plate and the temperature detection accuracy is prevented from being reduced due to the adhesion of toner on the heat collector plate. Regarding the second advantage, since the thermal energy is applied to the recording medium through the printed side thereof, when the temperature is detected at the unprinted side, the kind of the recording medium can be estimated from the detected temperature on the basis of differences in thermal conductivity from the printed side to the unprinted side depending on the kind of the recording medium. For example, the temperature of a thin recording medium is higher than the temperature of a thick recording medium at the unprinted side. Therefore, it can be determined that the recording medium is thin when the temperature detected by the temperature detecting portion placed downstream of the fixing nip portion is higher than a reference temperature, and thick when the detected temperature is lower than the reference temperature. The above-described temperature detecting method is particularly effective in a fixing device having a heat-generating unit on one side of the recording medium (printed side in this example) and not on the other side thereof (unprinted side in this example), as in the present embodiment.

Structure of Recording-Medium-Temperature Detector Unit

With reference to FIG. 1, a paper output guide (recording-medium guide member) 28 which defines a recording-medium conveying path is provided between the fixing nip portion N and an output roller nip portion (a conveying member nearest to the fixing nip portion N). The output roller nip portion includes the paper output rollers 26 and 27, one of which is driven by a motor (not shown). The paper output guide 28 is made of a material with high heat resistance such as PBT and PET. A conveying surface of the paper output guide 28 is positioned below an imaginary line A connecting the fixing nip portion N and the output roller nip portion. In addition, a conveying speed of the recording medium at the pair of paper output rollers is higher than that at the fixing nip portion. Accordingly, while the recording medium is being conveyed by both the fixing nip portion N and the output roller nip portion, the recording medium moves so as to approach the line A connecting the two nip portions.

The paper output guide 28 is provided with a recording medium detector (hereafter called a paper output sensor) which detects the passage (presence/absence) of the recording medium output from the heat-fixing device. The paper output sensor includes a sensor lever (moving member or movable lever) 29 and a photointerrupter 30. The sensor lever 29 has a plastic portion made of polyacetal or the like which provides high sliding performance, and is placed such that an end portion thereof blocks the line A connecting the fixing nip portion N and the output roller nip portion. When the recording medium passes by, the sensor lever 29 tilts in the sheet-conveying direction (FIG. 2), and a blocking portion (flag) blocks infrared light from the photointerrupter 30. When the recording medium is absent, the sensor lever 29 returns to its home position and the blocking portion moves to a position where it does not block the infrared light from the photointerrupter 30 (FIG. 1). Thus, the sensor lever 29 moves to block/unblock the infrared light from the photointerrupter 30, and thus the passage (presence/absence) of the recording medium is detected.

Figure 4:
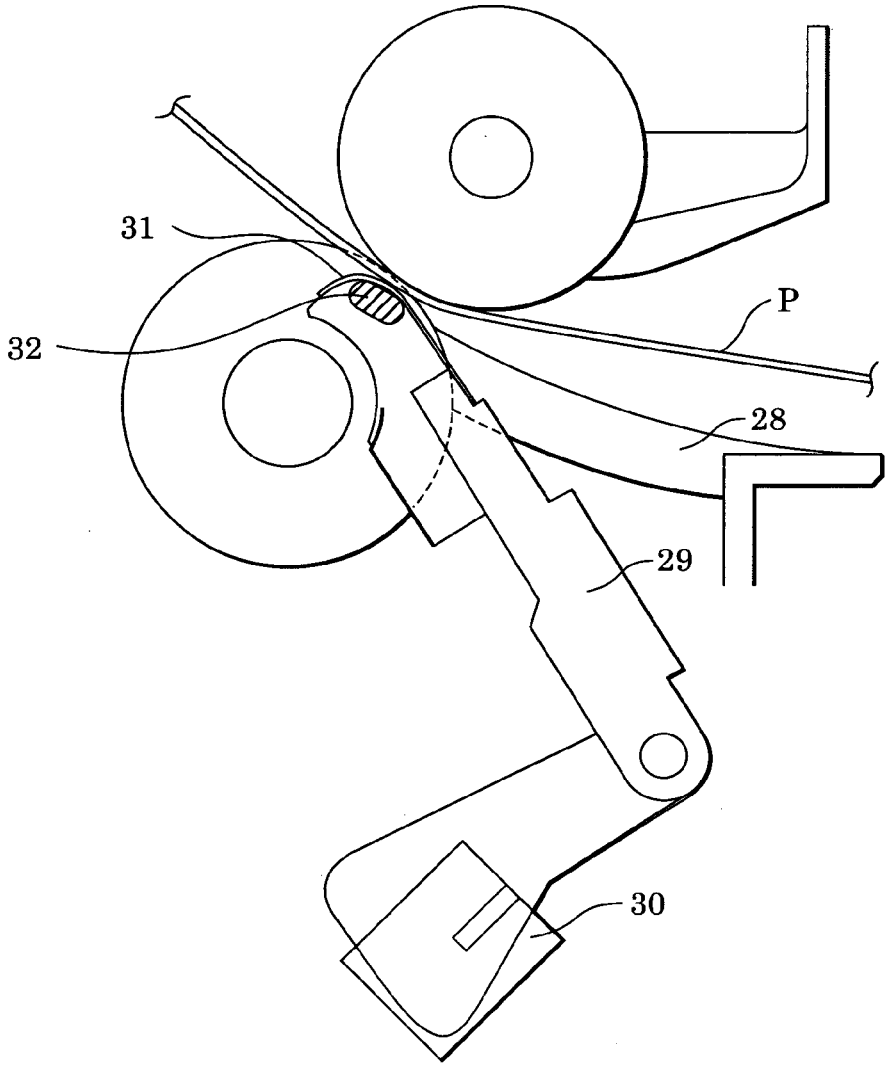
FIG. 4 is an enlarged sectional view showing the manner in which a recording medium temperature is detected according to the first embodiment of the present invention.

FIG. 4 is a detailed sectional view showing a region around the sensor lever 29. In the present embodiment, the sensor lever 29 is obtained by integrating a plastic substrate and a heat collector plate 31 by outsert molding. The heat collector plate 31 is composed of a thin plate (made of aluminum or stainless steel having a small thermal capacity) with a thickness of about 0.1 mm. In addition, electrodes (conductive members) 34 of a thermistor, which will be described below, is formed integrally on the sensor lever 29. These electrodes 34 function to urge the sensor lever 29 from a position where the sensor lever 29 is placed while the recording medium is passing by (temperature detection position) toward a position where the sensor lever 29 is placed while the recording medium is not passing by (home position). Due to this urging force, the heat collector plate 31 provided at the end of the sensor lever 29 comes into contact with the unprinted side of the recording medium.

Figure 7:
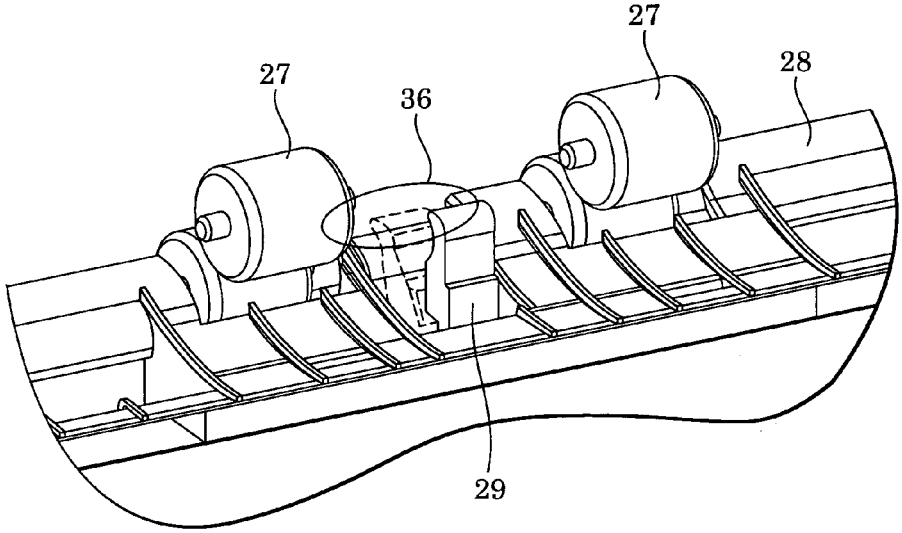
FIG. 7 is a perspective view showing a region at which the recording medium temperature is detected at an end of the sensor lever according to the first embodiment of the present invention.

When the sensor lever 29 is at the home position, the heat collector plate 31 is placed above the imaginary line A connecting the fixing nip portion N and the output roller nip portion so as to oppose the paper output guide 28 across the imaginary line A. When the front end of the recording medium is output from the fixing nip portion N, it comes into contact with the plastic portion of the sensor lever 29. Then, as the recording medium moves downstream, the sensor lever 29 rotates by being pressed by the recording medium, and the heat collector plate 31 comes into contact with the unprinted side of the recording medium. Since the heat collector plate 31 having a small thermal capacity is brought into contact with the recording medium, the temperature of the heat collector plate 31 is quickly changed to substantially the same temperature as that of the recording medium temperature. In order to reduce the thermal capacity of the heat collector plate 31, the dimensions of the heat collector plate 31 in the recording-medium conveying direction and in a direction perpendicular to the recording-medium conveying direction and approximately parallel to the width of the recording medium are preferably made as small as possible. In addition, when the sensor lever 29 is tilted by the recording medium (when the sensor lever 29 is at the temperature detection position), the temperature detecting portion of the sensor lever 29 is placed at substantially the same position as the nip portion of the paper output rollers 26 and 27 in the conveying direction of the recording medium (FIGS. 4 and 7). Accordingly, the position at which the sensor lever 29 urges the recording medium when the sensor lever 29 is at the temperature detection position is approximately the same as the nip position of the paper output rollers 26 and 27 in the recording-medium conveying direction. Therefore, the recording medium is prevented from being bent due to the urging force applied by the sensor lever 29. In addition, since the recording medium is prevented from being bent, it is prevented from being separated from the temperature detecting portion and the temperature detection accuracy can be increased.

In the case in which double-sided printing is performed in an image-forming apparatus having a double-sided printing function, the heat collector plate 31 comes into contact with the toner image on a first side of recording medium while a second side of the recording medium is being processed. Therefore, there is a risk that the toner will adhere on the surface of the heat collector plate 31. In order to prevent this, the surface of the heat collector plate 31 may be coated with Teflon (registered trademark) or be subjected to surface processing like UV coating without effecting the thermal conductivity of the heat collector plate 31. In addition, the surface of the heat collector plate 31 may also be coated with polyimide (PI) or the like.

A quick-response temperature detection sensor 32, such as a thermistor, is adhered on the bottom surface of the heat collector plate 31 at the end of the sensor lever 29 with an adhesive or the like. A gap between the thermistor and the heat collector plate 31 is filled with an adhesive or the like to ensure the thermal conductivity from the heat collector plate 31 to the thermistor.

When the recording medium P on which the image is fixed is conveyed from the heat-fixing device, it pushes the sensor lever 29 so as to rotate the sensor lever 29. Accordingly, the heat collector plate 31 comes into contact with the unprinted side of the recording medium P, receives heat from the recording medium P, and conducts heat to the temperature detection sensor 32 provided on the back. Thus, the recording medium temperature is detected. When the sensor lever 29 is rotated to the temperature detection position, that is, when the recording medium detector detects the presence of the recording medium P, the temperature detection sensor 32 is positioned directly below the position where the heat collector plate 31 comes into contact with the recording medium P. Therefore, the influence of the temperature gradient in the heat collector plate 31 is minimized and the detection accuracy of the recording medium temperature is increased. In addition, since a sliding portion which slides along the recording medium P is made of metal, abrasion of the sliding portion is prevented and the endurance of the sensor lever 29 is increased.

As described above, since the temperature detecting portion including the heat collector plate 31, the thermistor, etc., is provided on the sensor lever which detects the passage (presence/absence) of the recording medium, the position information and the temperature information of the recording medium are precisely synchronized with each other. In addition, the position on the recording medium corresponding to the temperature information obtained from the thermistor can be determined with high accuracy. More specifically, although the temperature information obtained at the rear end of the recording medium is normally higher then that obtained at the front end, the recording medium temperature can be more accurately determined using the position information of the recording medium in addition to the temperature information.

Figure 5:
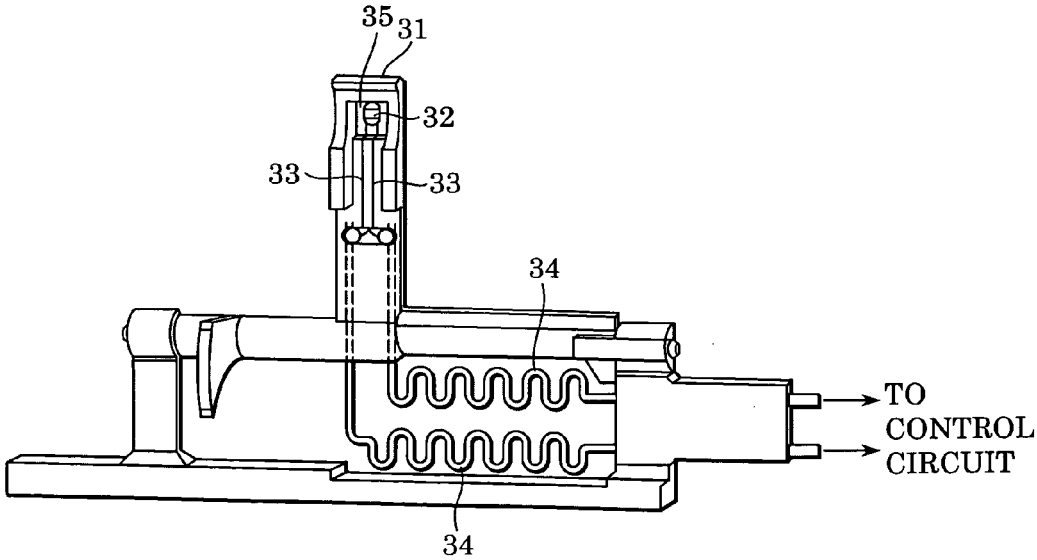
FIG. 5 is a perspective view of a sensor lever according to the first embodiment of the present invention seen from the downstream in a recording-medium conveying direction.
Figure 6:
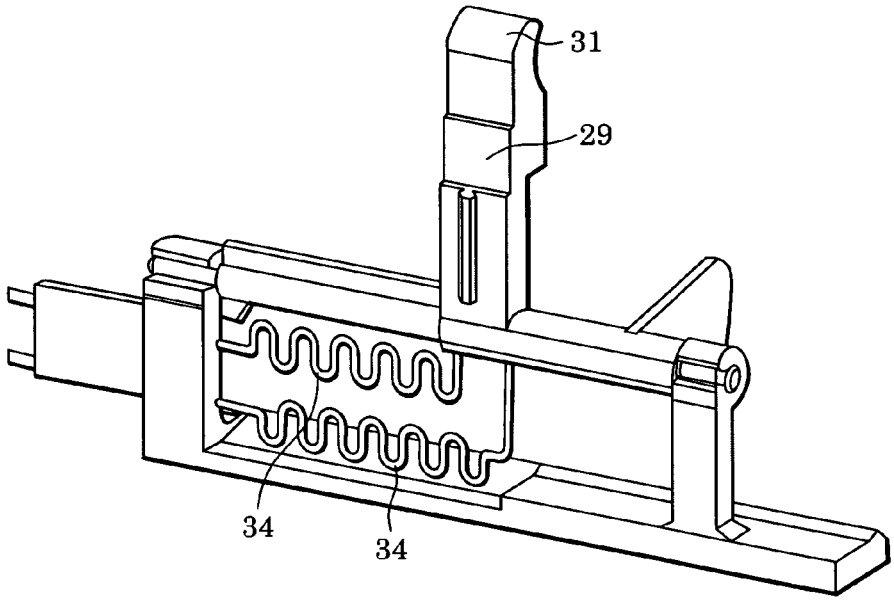
FIG. 6 is a perspective view of the sensor lever according to the first embodiment of the present invention seen from the upstream in a recording-medium conveying direction.

The thermistor is an element having a resistance which varies depending on a temperature, and is enclosed in glass in such a manner that dumet wires 33 are printed on electrodes of a thermistor chip. In addition, the plastic portion of the sensor lever and two electrodes 34 made of metal, such as stainless steel, are integrally formed by outsert molding or the like (FIGS. 5 and 6). The dumet wires 33 are welded to the respective electrodes 34. In addition, the electrodes 34 are connected to a control circuit to transmit the temperature information detected by the thermistor.

The electrodes (conductive member) 34 are composed of thin plates of stainless steel, phosphor bronze, beryllium bronze, titanium bronze, or the like with a thickness of about 0.1 mm, and serve as a signal path for transmitting the temperature information obtained from the thermistor to the control circuit. In addition, the electrodes 34 also serve a function of urging the sensor lever 29 from the temperature detection position toward the home position. The electrodes 34 are integrated with the plastic portion of the sensor lever 29. In addition, the electrodes 34 are welded to the respective dumet wires 33 of the thermistor at one end thereof and are connected to a terminal fixed on the paper output guide at the other end. When the sensor lever 29 is rotated toward the temperature detection position from the home position, the electrodes 34 are twisted about the end connected to the terminal due to the rotation of the sensor lever 29. Accordingly, a force for returning the sensor lever 29 to the home position is generated. As shown in FIGS. 5 and 6, the electrodes 34 have a crank shape so that an adequate rotational force is applied to the sensor lever 29 and the electrodes 34 are prevented from causing permanent deformation or breaking by repeatedly receiving stress.

Next, the end portion of the sensor lever 29 will be described in more detail below. As described above, at the end portion of the sensor lever 29, the heat collector plate 31 made of a material with a small thermal capacity is formed integrally with the plastic portion having a low thermal conductivity. The heat collector plate 31 has a hollow section 35 in the back in a region excluding the region at which the plastic portion is bonded. Accordingly, the back surface of the heat collector plate 31 is exposed when the sensor lever 29 is viewed from the downstream in the recording-medium conveying direction (FIG. 5). Accordingly, the thermal capacity near the heat-collecting portion is reduced and heat collected at the temperature detection sensor 32 is prevented from being dissipated. Accordingly, the responsiveness of the temperature detection sensor 32 is increased.

Next, the region around the sensor lever 29 will be described below with reference to FIG. 7. Each pair of output rollers (conveying unit) consist of a paper output roller 26 made of rubber and driven by a driving motor and a paper output roller 27 driven by the output rubber roller 26. The paper output guide 28 has a large recess 36 at a position where the sensor lever 29 rotates, so that the recording medium does not come into contact with the surface of the paper output guide in a region near the position at which the recording medium comes into contact with the sensor lever 29. Accordingly, heat is prevented from being dissipated to the paper output guide in a region around the heat collecting portion, and the detection accuracy of the recording medium temperature is increased. In addition, as shown in FIGS. 4 and 7, in the state in which the sensor lever 29 is tilted by the recording medium (when the sensor lever 29 is at the temperature detection position), the temperature detecting portion of the sensor lever 29 is placed at substantially the same position as the nip portion of the paper output rollers 26 and 27 in the conveying direction of the recording medium. Accordingly, the position at which the sensor lever 29 urges the recording medium when the sensor lever 29 is at the temperature detection position is approximately the same as the nip position of the paper output rollers 26 and 27 in the recording-medium conveying direction. Therefore, the recording medium is prevented from being bent due to the urging force applied by the sensor lever 29. In addition, since the recording medium is prevented from being bent, it is prevented from being separated from the temperature detecting portion and the temperature detection accuracy can be increased.

Second Embodiment

Figure 8:
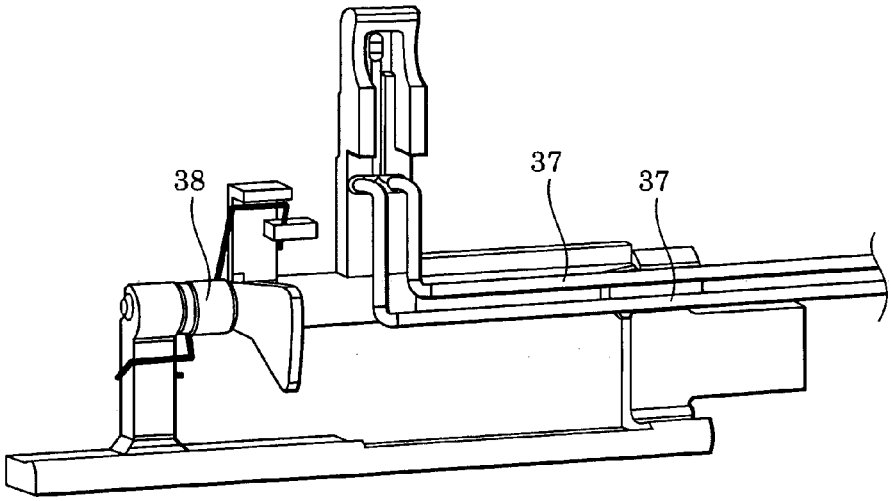
FIG. 8 is a perspective view of a sensor lever according to a second embodiment of the present invention seen from the downstream in a recording-medium conveying direction.

Next, a second embodiment of the present invention will be described below with reference to FIG. 8. In the second embodiment, dumet wires of a thermistor are directly connected to respective lead wires 37. The lead wires 37 are connected to a control circuit through a rotating shaft of a sensor lever to transmit temperature information detected by a thermistor. In addition, a normal torsion coil spring 38 applies a rotational force to the sensor lever.

As described above, according to the present embodiment, the torsion coil spring 38 applies the rotational force to the sensor lever and the lead wires 37 for transmitting the output from the thermistor extend through the rotating shaft of the sensor lever. Thus, an inexpensive, simple temperature detection sensor which reliably functions as long as the number of times the sensor lever is rotated is small is obtained.

Third Embodiment

Figure 12:
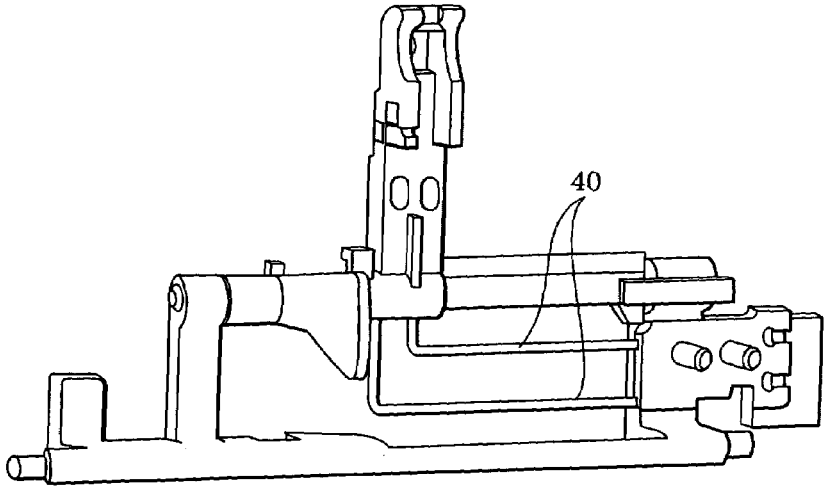
FIG. 12 is a perspective view of a sensor lever according to a third embodiment of the present invention seen from the downstream in a recording-medium conveying direction.

Next, a third embodiment of the present invention will be described below with reference to FIG. 12. FIG. 12 is a perspective view of a sensor lever according to the third embodiment seen from the downstream in a recording-medium conveying direction.

In the present embodiment, electrodes 40 are composed of thin plates of stainless steel, phosphor bronze, beryllium bronze, titanium bronze, or the like with a thickness of about 0.1 mm, and serve as a signal path for transmitting the temperature information obtained from the thermistor to the control circuit. In addition, the electrodes 40 also serve a function of applying a rotational force to a sensor lever. The electrodes 40 are integrated with a plastic portion of the sensor lever and welded to respective dumet wires of the thermistor at one end thereof, and are connected to a terminal fixed on a paper output guide at the other end. When the sensor lever is rotated, the electrodes 40 move along with the sensor lever, and are deflected and twisted about the end-connected to the terminal. Thus, the electrodes 40 applies a rotational force for returning the sensor lever to the home position. In addition, the electrodes 40 have square or round corners so that an adequate rotational force is applied to the sensor lever and the electrodes are prevented from causing permanent deformation or breaking by repeatedly receiving stress.

Fourth Embodiment

Figure 13:
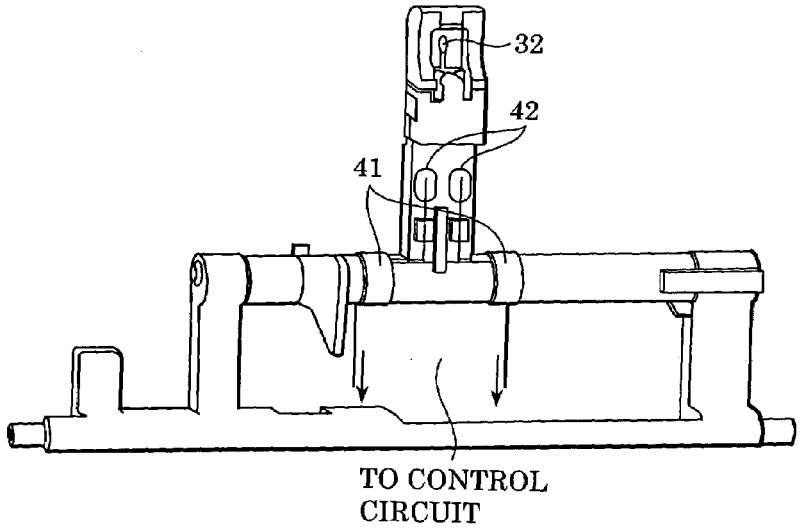
FIG. 13 is a perspective view of a sensor lever according to a fourth embodiment of the present invention seen from the downstream in a recording-medium conveying direction.

Next, a fourth embodiment of the present invention will be described below with reference to FIG. 13. FIG. 13 is a perspective view of a sensor lever according to the fourth embodiment seen from the downstream in a recording-medium conveying direction.

In the present embodiment, electrodes 41 are composed of metal torsion coil springs made of SUS, SWC, SWPB, etc., and these torsion coil springs serve both to transmit temperature information obtained from a thermistor 32 to a control circuit and to apply a rotational force to a sensor lever. The electrodes 41 are welded to respective metal plates 42 made of SUS or the like which are inserted into a plastic portion of the sensor lever at one end thereof. Dumet wires of the thermistor 32 are also welded to the inserted metal plates 42, and thus a signal path for the temperature information from the thermistor is provided. The electrodes 41 are connected to a control circuit path of the temperature information from the thermistor at the other end. In addition, the electrodes 41 serve as torsion coil springs which apply a rotational force for returning the sensor lever to the home position.

Fifth Embodiment

Anti-Electrostatic Structure

Figure 14:
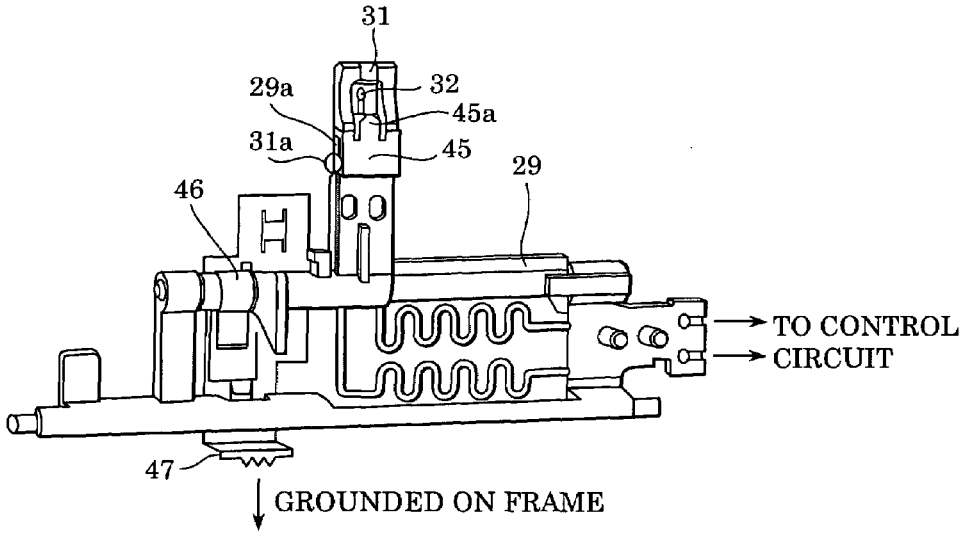
FIG. 14 is a perspective view of a sensor lever according to a fifth embodiment of the present invention seen from the downstream in a recording-medium conveying direction, the sensor lever incorporating an antistatic structure.

The above-described temperature detectors have a risk of causing a damage due to static electricity. For example, there is a possibility that the sensor lever 29 will be touched by a user's finger when a jam recovery process or the like is performed. In such a case, if the user's finger is charted with static electricity, there is a risk that the thermistor 32 will be damaged due to the static electricity discharged from the user's finger. In addition, static electricity charges on the heat collector plate 31 of the sensor lever 29 when it slides along the recording medium, and this may also damage the thermistor 32. In order to prevent such a damage, in the present embodiment, an anti-electrostatic structure shown in FIG. 14 is used. FIG. 14 is a perspective view of a sensor lever similar to that shown in FIGS. 5 and 6 except an antistatic structure is attached, seen from the downstream in the recording-medium conveying direction.

A metal conductive part 45 made of stainless steel or the like, which is a part of an antistatic structure, is provided on a side of a sensor lever 29 which does not come into contact with the recording medium. The conductive part 45 is, for example, fitted to the sensor lever 29. In addition, a heat collector plate 31 includes a connector 31*a* which is exposed from a resin surface of the sensor lever 29 and connected to the conductive part 45 to which a preload is applied. The conductive part 45 is obtained by bending a metal plate, and is prevented from being released from the sensor lever 29 by claws 29*a* provided one on each side. Accordingly, even when, for example, a jam recovery process or the like is performed, the conductive part 45 is prevented from being detached from the sensor lever 29.

In addition, a grounding spring 46 composed of a spring with a diameter of $\phi$=0.1 to 0.2, which is also a part of the antistatic structure, is attached to the sensor lever 29. The grounding spring 46 is connected to the conductive part 45 at one end and to a grounding path 47 at the other end. The grounding path 47 is grounded on a metal plate frame of a heat-fixing unit. Accordingly, the grounding spring 46 serves to ground the heat collector plate 31 via the conductive part 45.

The heat collector plate 31 is grounded via the conductive part 45, the grounding spring 46, and the grounding path 47, and is thereby prevented from being charged with static electricity when it slides along the recording medium.

In addition, the conductive part 45 is provided with a projection 45*a* which functions as a conductor. When, for example, a user's finger that is charged with static electricity approaches, the static electricity is discharged from the projection 45*a* of the conductive part 45 to the ground via the grounding spring 46 and the grounding path 47. Thus, the thermistor is prevented by being damaged by static electricity.

Sixth Embodiment

Figure 15:
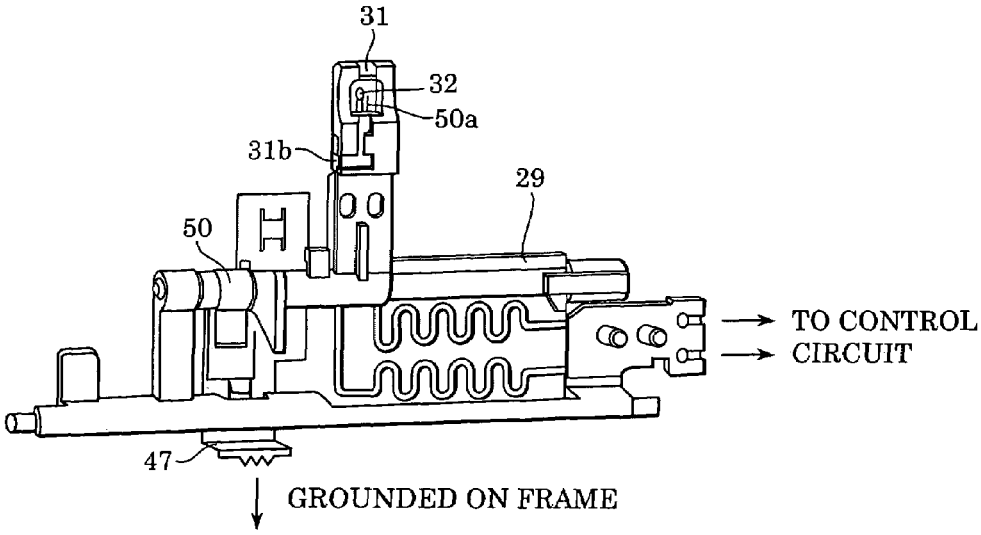
FIG. 15 is a perspective view of a sensor lever according to a sixth embodiment of the present invention seen from the downstream in a recording-medium conveying direction.

FIG. 15 is a perspective view showing a sixth embodiment of the present invention. Since the basic structure and operation in the sixth embodiment is similar to those of the first embodiment, only a characterizing part of the sixth embodiment will be described below.

A torsion coil spring 50 which applies a spring force to a sensor lever 29 in a direction opposite to the rotating direction thereof is attached to the sensor lever 29. One end of the torsion coil spring 50 is connected to a grounding path 47 which is grounded on a metal plate frame of a fixing unit. The other end of the torsion coil spring 50 is disposed near a thermistor on the back side of a heat collector plate 31, and functions as a conductor which discharges static electricity to the ground when, for example, a user's finger charged with static electricity approaches. Thus, the thermistor is prevented by being damaged by static electricity. In addition, the heat collector plate 31 is connected to the torsion coil spring 50 via a cutout section 31*b*, and is thereby prevented from being charged with static electricity when it slides along the recording medium.

Seventh Embodiment

Figure 16:
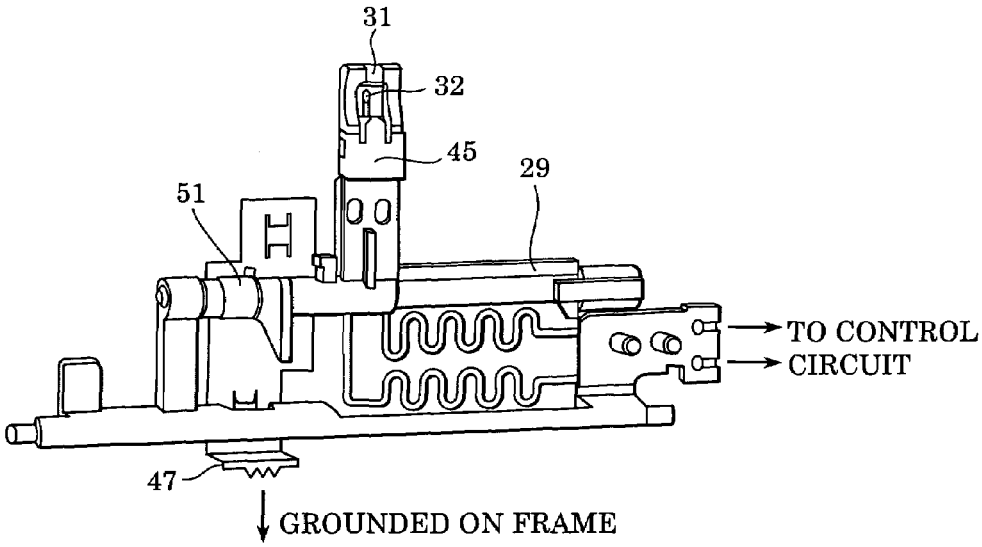
FIG. 16 is a perspective view of a sensor lever according to a seventh embodiment of the present invention seen from the downstream in a recording-medium conveying direction.

FIG. 16 is a perspective view showing a seventh embodiment of the present invention. Since the basic structure and operation in the seventh embodiment is similar to those of the first embodiment, only a characterizing part of the seventh embodiment will be described below.

A rotatable torsion coil member 51 is attached to a shaft around which a sensor lever 29 rotates. A coil portion of the torsion coil member 51 is connected to a grounding path 47, which is grounded on a metal plate frame of a fixing unit. The other end of the torsion coil member 51 is connected to a conductive part 45. The conductive part 45 functions as a conductor which discharges static electricity to the ground when, for example, a user's finger charged with static electricity approaches. Thus, the thermistor is prevented by being damaged by static electricity. In addition, the heat collector plate 31 is connected to the torsion coil member 51 via the conductive part 45, and is thereby prevented from being charged with static electricity when it slides along the recording medium.

Since the coil member 51 is rotatable and does not generate an urging force, the rotational urging force applied to the sensor lever is reduced. Therefore, this structure is advantageous in double-sided printing since adhesion of the toner on the heat collector plate or removal of an image can be prevented when the heat collector plate 31 slides along the surface of the recording medium on which the image is formed.

The present invention is not limited to the above-described embodiments, and various modifications are possible within the scope of the prevent invention.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-115595 filed Apr. 9, 2004, Japanese Patent Application No. 2004-115597 filed Apr. 9, 2004, and Japanese Patent Application No. 2004-054638 filed Feb. 27, 2004, which are hereby incorporated by reference herein.

What is claimed is:

1. An image-forming apparatus comprising:

an image-forming unit which forms an image on a recording medium;

a temperature detector which detects a temperature of the recording medium; and a recording medium detector which detects a passage of the recording medium, said recording medium detector including a moving member which moves when the recording medium comes into contact with said moving member, wherein a temperature detecting portion of said temperature detector is disposed on said moving member.

2. The apparatus according to claim 1, further comprising a fixing unit which fixes the image on the recording medium by applying heat, said fixing unit including a fixing nip portion which nips and conveys the recording medium, wherein said recording medium detector is disposed downstream of the fixing nip portion in a moving direction of the recording medium.

3. The apparatus according to claim 2, wherein the temperature detecting portion is disposed so as to come into contact with a surface of the recording medium opposite to a surface on which the image is formed in single-sided printing.

4. The apparatus according to claim 2, further comprising a conveying unit which conveys the recording medium, the conveying unit being disposed downstream of the fixing nip portion in the moving direction of the recording medium and being driven by a drive source, wherein said moving member comes into contact with the recording medium in a region between the fixing nip portion and a portion of said conveying unit nearest to the fixing nip portion in the moving direction of the recording medium.

5. The apparatus according to claim 4, further comprising a recording-medium guide member disposed between said fixing unit and said conveying unit, wherein a speed at which said conveying unit conveys the recording medium is higher than a speed at which said fixing unit conveys the recording medium, and wherein the recording medium does not comes into contact with said recording-medium guide member while the recording medium is retained by both said fixing unit and said conveying unit.

6. The apparatus according to claim 4, further comprising a recording-medium guide member disposed between said fixing unit and said conveying unit, wherein the temperature detecting portion is disposed so as to oppose said recording-medium guide member across an imaginary line connecting the fixing nip portion and a nip portion included in said conveying unit at least in a state in which a front end of the recording medium is not yet output from the fixing nip portion.

7. The apparatus according to claim 1, wherein said moving member moves from a home position to a temperature detection position when the recording medium comes into contact with said moving member, and returns to the home position when the recording medium separates from said moving member.

8. The apparatus according to claim 1, wherein said moving member tilts in a moving direction of the recording medium when the recording medium comes into contact with said moving member.

9. The apparatus according to claim 7, wherein electrodes of the temperature detecting portion are attached to said moving member, the electrodes serving a function of returning said moving member to the home position.

10. The apparatus according to claim 7, further comprising an urging member which urges said moving member toward the home position, wherein the temperature detecting portion is provided with electric wires which extend from the temperature detecting portion and disposed near a rotating shaft of said moving member.

11. The apparatus according to claim 2, further comprising a conveying unit which conveys the recording medium, said conveying unit being disposed downstream of the fixing nip portion in the moving direction of the recording medium and being driven by a drive source, wherein the temperature detecting portion is at an approximately the same position as a nip portion included in said conveying unit in the moving direction of the recording medium when said moving member is moved to a temperature position at which the temperature is detected.

12. The apparatus according to claim 1, wherein the temperature detecting portion includes a heat transmit plate which comes into contact with the recording medium at one side of the heat transmit plate and a temperature-detecting element disposed on the other side of the heat transmit plate.

13. The apparatus according to claim 12, wherein the heat transmit plate comprises metal.

14. The apparatus according to claim 12, wherein said moving member includes a resin base and the heat transmit plate is attached to the resin base.

15. The apparatus according to claim 2, wherein said fixing unit includes a heating unit and a back-up unit, said heating unit being disposed so as to face a surface of the recording medium on which the image is formed in single-sided printing.

16. The apparatus according to claim 2, wherein the apparatus determines a set temperature of said fixing unit on the basis of the temperature detected by said temperature detector.

17. The apparatus according to claim 15, wherein said heating unit includes a flexible sleeve and a heater which is in contact with an inner peripheral surface of said flexible sleeve and which is controlled so as to maintain a set temperature, wherein said back-up unit includes a pressure roller which is in contact with an outer peripheral surface of said flexible sleeve, said heater and said pressure roller defining the fixing nip portion with said flexible sleeve provided therebetween, and wherein the apparatus determines the set temperature of said heater on the basis of the temperature detected by the temperature detector.

18. A recording-medium-temperature detector unit for use in an image-forming apparatus which forms an image on a recording medium, said unit comprising:

a movable lever which is composed of resin and which moves when the recording medium comes into contact with said movable lever;

a temperature-detecting element provided on said movable lever; and an elastic conductive member provided on said movable lever and electrically connected to said temperature-detecting element, wherein said conductive member defines a signal path for said temperature-detecting element and applies an elastic force for urging said movable lever against the recording medium.

19. The detector unit according to claim 18, wherein said conductive member is formed integrally with said movable lever.

20. The detector unit according to claim 18, wherein said conductive member is a plate spring.

21. The detector unit according to claim 18, wherein said conductive member is a torsion coil spring.

22. The detector unit according to claim 18, wherein said conductive member has a crank shape.

23. The detector unit according to claim 18, further comprising a heat transmit plate provided on one side of said movable lever at a position such that said heat transmit plate comes into contact with the recording medium, wherein said temperature-detecting element is provided on the other side of said heat transmit plate.

24. The detector unit according to claim 18, wherein said detector unit serves a flag function for detecting the passage of the recording medium.

25. An image-forming apparatus comprising:

an image-forming unit which forms an image on a recording medium;

a movable lever which is composed of resin and which moves when the recording medium comes into contact with said movable lever;

a heat transmit plate provided on said movable lever such that said heat transmit plate comes into contact with the recording medium at one side of said heat transmit plate;

a temperature-detecting element provided on the other side of said heat transmit plate; and a conductive part which is electrically connected to a grounding path, said conductive part being positioned so as to prevent an electric discharge to said temperature-detecting element.

26. The apparatus according to claim 25, wherein said conductive part is electrically connected to said heat transmit plate.

27. The apparatus according to claim 25, further comprising a spring which electrically connects said conductive part to the grounding path.

28. The apparatus according to claim 27, wherein one end of the spring is connected to the grounding path so as to press the grounding path and the other end of the spring urges said movable lever in a direction opposite to the direction in which said movable lever moves when the recording medium comes into contact with said movable lever.

29. The apparatus according to claim 25, wherein said conductive part comprises a spring, one end of the spring being connected to the grounding path so as to press the grounding path and the other end of the spring urging said movable lever in a direction opposite to the direction in which said movable lever moves when the recording medium comes into contact with said movable lever.

30. The apparatus according to claim 25, wherein said heat transmit plate is disposed so as to come into contact with a surface of the recording medium opposite to a surface on which the image is formed in single-sided printing.

31. The apparatus according to claim 25, further comprising a fixing unit which fixes the image on the recording medium by applying heat, said fixing unit including a fixing nip portion which nips and conveys the recording medium, wherein said movable lever is disposed downstream of the fixing nip portion in a moving direction of the recording medium.

32. The apparatus according to claim 25, wherein said movable lever moves from a home position to a temperature detection position when the recording medium comes into contact with said movable lever, and returns to the home position when the recording medium separates from said movable member.

33. The apparatus according to claim 32, wherein electrodes of the temperature detecting portion are attached to said moving member, the electrodes serving a function of returning said moving member to the home position.

34. The apparatus according to claim 32, further comprising an urging member which urges said movable lever toward the home position, wherein said temperature-detecting element is provided with electric wires which extend from said temperature-detecting element and disposed near a rotating shaft of said moving member.

35. The apparatus according to claim 31, wherein said fixing unit includes a heating unit and a back-up unit, said heating unit being disposed so as to face a surface of the recording medium on which the image is formed in single-sided printing.

36. An image-forming apparatus comprising:

an image-forming unit which forms an image on a recording medium;

a movable lever which is composed of resin and which moves when the recording medium comes into contact with said movable lever;

a heat transmit plate provided on said movable lever such that the heat transmit plate comes into contact with the recording medium at one side of said heat transmit plate;

a temperature-detecting element provided on the other side of said heat transmit plate; and a conductive part electrically connected to both said heat transmit plate and a grounding path.

37. The apparatus according to claim 36, further comprising a spring which electrically connects said conductive part to the grounding path.

38. The apparatus according to claim 37, wherein one end of the spring is connected to the grounding path so as to press the grounding path and the other end of the spring urges said movable lever in a direction opposite to the direction in which said movable lever moves when the recording medium comes into contact with said movable lever.

39. The apparatus according to claim 36, wherein said conductive part comprises a spring, one end of the spring being connected to the grounding path so as to press the grounding path and the other end of the spring urging said movable lever in a direction opposite to the direction in which said movable lever moves when the recording medium comes into contact with said movable lever.

40. The apparatus according to claim 36, wherein said heat transmit plate is disposed so as to come into contact with a surface of the recording medium opposite to a surface on which the image is formed in single-sided printing.

41. A recording-medium-temperature detector unit for use in an image-forming apparatus which forms an image on a recording medium, the detector unit comprising:

a movable lever which is composed of resin and which moves when the recording medium comes into contact with said movable lever;

a heat transmit plate provided on said movable lever such that said heat transmit plate comes into contact with the recording medium at one side of said heat transmit plate;

a temperature-detecting element provided on the other side of said heat transmit plate; and a conductive part which is electrically connected to a grounding path, said conductive part being positioned so as to prevent an electric discharge to said temperature-detecting element.

42. The detector unit according to claim 41, wherein said conductive part is electrically connected to said heat transmit plate.

43. The detector unit according to claim 41, further comprising a spring which electrically connects said conductive part to the grounding path.

44. The detector unit according to claim 43, wherein one end of the spring is connected to the grounding path so as to press the grounding path and the other end of the spring urges said movable lever in a direction opposite to the direction in which said movable lever moves when the recording medium comes into contact with said movable lever.

45. The detector unit according to claim 41, wherein said conductive part comprises a spring, one end of the spring being connected to the grounding path so as to press the grounding path and the other end of the spring urging said movable lever in a direction opposite to the direction in which said movable lever moves when the recording medium comes into contact with said movable lever.

46. A recording-medium-temperature detector unit for use in an image-forming apparatus which forms an image on a recording medium, the detector unit comprising:

a movable lever which is composed of resin and which moves when the recording medium comes into contact with said movable lever;

a heat transmit plate provided on said movable lever such that said heat transmit plate comes into contact with the recording medium at one side of said heat transmit plate;

a temperature-detecting element provided on the other side of said heat transmit plate; and a conductive part electrically connected to both said heat transmit plate and a grounding path.

47. The detector unit according to claim 46, further comprising a spring which electrically connects said conductive part to the grounding path.

48. The detector unit according to claim 47, wherein one end of the spring is connected to the grounding path so as to press the grounding path and the other end of the spring urges said movable lever in a direction opposite to the direction in which said movable lever moves when the recording medium comes into contact with said movable lever.

49. The detector unit according to claim 46, wherein said conductive part comprises a spring, one end of the spring being connected to the grounding path so as to press the grounding path and the other end of the spring urging said movable lever in a direction opposite to the direction in which said movable lever moves when the recording medium comes into contact with said movable lever.

* * * * *

UNITED STATES PATENT AND TRADEMARK OFFICE

CERTIFICATE OF CORRECTION

PATENT NO. : 7,280,775 B2
APPLICATION NO. : 11/055786
DATED : October 9, 2007
INVENTOR(S) : Yutaka Kubochi et al.

It is certified that error appears in the above-identified patent and that said Letters Patent is hereby corrected as shown below:

ON THE TITLE PAGE

At Item (56), Foreign Patent Documents:

"EP 676677 A2 * 10/1995" should read --EP 0 676 677 A2 * 10/1995--.
"JP 2001282036 A * 10/2001" should read --JP 2001-282036 A * 10/2001--.
"JP 2002156866 A * 5/2002" should read --JP 2002-156866 A * 5/2002--.
"JP 2003140502 A * 5/2003" should read --2003-140502 A * 5/2003--.
"JP 2003280447 A * 10/2003" should read --2003-280447 A * 10/2003--.
"JP 2003330315 A * 11/2003" should read --2003-330315 A * 11/2003--.

COLUMN 9

Line 38, "then" should read --than--.

COLUMN 11

Line 30, "end-connected" should read --end connected--.

COLUMN 14

Line 27, "comes" should read --come--.

Signed and Sealed this

Thirtieth Day of September, 2008

JON W. DUDAS
*Director of the United States Patent and Trademark Office*